US006416099B1

(12) United States Patent
James, Jr.

(10) Patent No.: US 6,416,099 B1
(45) Date of Patent: Jul. 9, 2002

(54) LIFTING TOOL FOR AUTOMATIC CENTERING AND 180 DEGREE ROTATION

(75) Inventor: Frank Ward James, Jr., Athens, GA (US)

(73) Assignee: ABB Technology AG, Zurich (CH)

( * ) Notice: Subject to any disclaimer, the term of this patent is extended or adjusted under 35 U.S.C. 154(b) by 0 days.

(21) Appl. No.: 09/727,316

(22) Filed: Nov. 30, 2000

(51) Int. Cl.[7] ..... B66C 1/42

(52) U.S. Cl. ..... 294/86.41; 294/67.5; 414/783

(58) Field of Search ..... 294/86.41, 81.3, 294/81.4, 81.51, 81.54, 67.21, 67.22, 67.31, 67.33, 67.5, 90, 111, 68.26; 414/732–738, 741, 743, 783, 626, 422

(56) References Cited

U.S. PATENT DOCUMENTS

| | | | | |
|---|---|---|---|---|
| 1,712,870 A | | 5/1929 | Coe | |
| 2,399,360 A | | 4/1946 | Lacey | 294/78 |
| 2,448,124 A | | 8/1948 | Roy | 212/9 |
| 3,436,116 A | | 4/1969 | Anderson | 294/103 |
| 3,863,971 A | * | 2/1975 | Meads et al. | 294/63.1 |
| 4,595,225 A | | 6/1986 | Kemble et al. | 294/86.41 |
| 5,094,495 A | * | 3/1992 | Littell | 294/65 |
| 6,209,938 B1 | * | 4/2001 | James, Jr. | 294/67.5 |
| 6,322,117 B1 | * | 11/2001 | James, Jr. | 294/67.5 |

FOREIGN PATENT DOCUMENTS

FR 1207913 2/1960

OTHER PUBLICATIONS

Drawings (2 sheets) Lifting Tool for Safe 90 Degree Rotation: original concept applied to Vacuum Lifting Tool by F. James, 1991.

Drawings (1 sheet) Vacuum Handling Device Interlock Schematic & Adjusting Instructions, D. W. Zimmerman Mfg., Inc., 1991.

Drawings (1 sheet) Small Tank 90 Degree Rotation Grab—Air Control Arrangement, ABB Power T&D Company, Inc., Aug. 6, 1991.

Drawings (2 sheets) Side Elevation of Vacuum Lifting Tool Prior to Modification for Safe 90 Degree Rotation—Goodyear "Ortec" (1991); (Sh. 1 of 2) Plan View of Vacuum Lifting Tool Prior to Modification for Safe 90 Degree Rotation, 1991 (Sh. 2 of 2).

* cited by examiner

*Primary Examiner*—Dean J. Kramer
(74) *Attorney, Agent, or Firm*—Woodcock Washburn LLP

(57) ABSTRACT

A tool for lifting and rotating an object having a center of gravity is provided. The tool includes a first rail, which is adapted to be coupled to a first end of the object, and a second rail, which is adapted to be coupled to a second end of the object. Inversion linkage is coupled to the first rail and to the second rail. The inversion linkage includes a pivot pin that automatically moves into coincidence with the center of gravity of the object when the first rail is coupled to the first end of the object and the second rail is coupled to the second end of the object.

10 Claims, 3 Drawing Sheets

LIFTING TOOL FOR AUTOMATIC CENTERING AND 180 DEGREE ROTATION

RELATED APPLICATION

The subject matter disclosed herein is related to the subject matter disclosed in U.S. Pat. No. 6,209,938, entitled "Lifting Tool For Safe 90 Degree Rotation," the contents of which are hereby incorporated by reference. The subject matter disclosed herein is related to the subject matter disclosed in U.S. Pat. No. 6,322,117, entitled "Lifting Tool For Safe 105 Degree Rotation," the contents of which are hereby incorporated by reference.

FIELD OF THE INVENTION

The present invention relates generally to lifting tools. More particularly, the present invention relates to lifting tools for automatic centering and 180 degree rotation of large objects, such as rectangular transformer tanks

BACKGROUND OF THE INVENTION

It is often necessary to lift large, heavy objects during a manufacturing process, such as, for example, during the process of painting steel enclosures (known as "tanks") for pad mounted transformers. Transformer tanks are usually either cylindrical or rectangular, and are typically painted in an automatic paint facility.

Before the tanks are painted, however, they are typically processed through a manual "shot blast" machine that uses small steel grit to prepare the tank surface for painting. Cylindrical tanks typically arrive at the shot blast machine open end up. To ensure that the steel grit does not accumulate inside the tank, each tank must be turned upside down and centered on a table that carries the tank into the shot blast machine. The table rotates during the blasting operation so that the perimeter of the tank can be properly blasted. Cylindrical tanks typically have attachments, known as "lifting tugs," that provide a place to hook the tank using a hoist, and allow it to lean over several degrees and be placed on its side on the table. Then, a bottom loop on the tank is hooked to pull the tank up vertically, and set it down on its open end. Cylindrical tanks remain upside down for subsequent operations in the painting process.

This method of tank rotation has proven to be ineffective for rectangular tanks, however. Due to the placement of attachments, the tank is more difficult to control safely as it is picked up, and is awkward to handle as it is placed on the table on its side and then turned upside down and centered. This is especially true for rectangular tanks, as it is desirable to turn the tanks over again, after the manual shot blast operation, to keep them open end up for the subsequent operations in the painting process. Again, it is awkward and takes effort to pick up the tanks from the table and place them on a transport cart easily and safely.

As a tank typically weighs more than 50 pounds (and frequently up to as much as 100 pounds or more), a tank is too heavy and too large for an ordinary person to manipulate without the aid of a lifting tool. Copending application Ser. No. 09/473,887, entitled "Lifting Tool For Safe 90 Degree Rotation," discloses and claims a lifting tool for safe 90 degree rotation of large heavy objects. Copending application Ser. No. 09/473,880, entitled "Lifting Tool For Safe 105 Degree Rotation," discloses and claims a lifting tool for safe 105 degree rotation of large heavy objects. The lifting tools described in these applications, while suitable for 90 and 105 degree rotation, respectively, are not optimal for rotation of up to 180 degrees. Thus, there is a need in the art for a lifting tool that can be used for automatic centering and 180 degree rotation of large objects, such as rectangular transformer tanks.

SUMMARY OF THE INVENTION

The present invention satisfies these needs in the art by providing lifting tools for automatic centering and 180 degree rotation of large objects, such as rectangular transformer tanks. A lifting tool according to the present invention includes a first rail, which is adapted to be coupled to a first end of the object, and a second rail, which adapted to be coupled to a second end of the object. Two sets of inversion linkage are coupled to ends of the rails.

Each set of inversion linkage includes a pivot pin and a plurality of components that cooperate to move the pivot pin to coincide with the center of gravity of an object that the tool has been sized and shaped to lift and invert. Specifically, inversion linkage for lifting and inverting rectangular enclosures, such as transformer tanks, can include a first telescoping member, and a second telescoping member slidably coupled to the first telescoping member. The second telescoping member moves axially relative to the first telescoping member. The slider rail is fixedly connected to an exterior of the first telescoping member, and has a slot elongated along a length thereof.

The linkage also includes a first rotational member, which is fixedly coupled to the first telescoping member, and a second rotational member, which is rotationally coupled to the first rotational member. The second rotational member has a slot elongated along a length thereof, and is coupled to the slider rail by the pivot pin, which extends through both the slider rail slot and the second rotational member slot. When the second telescoping member is moved axially relative to the first telescoping member, the pivot pin also moves axially relative to the first telescoping member. The distance by which the pivot pin moves is proportional to the distance by which the second telescoping member is moved. Thus, when the tool is sized to fit a particular enclosure (by moving the second telescoping member relative to the first), the pivot pin automatically moves in coincidence with the center of gravity of the enclosure.

The lifting tool can also include a third rotational member, which is rotationally coupled to the second rotational member, and a fourth rotational member, which is rotationally coupled to the third rotational member and fixedly coupled to the second telescoping member.

The lifting tool can also include an enclosure grasping assembly coupled to the second rail, which is adapted to couple the second rail to the second end of the object. The enclosure grasping assembly can include a first structural angle, which is fixedly coupled to the second rail, and a second structural angle, which is fixedly coupled to the first structural angle so as to form a groove between the structural angles for receiving the second end of the object.

BRIEF DESCRIPTION OF THE DRAWINGS

The foregoing summary, as well as the following detailed description of the preferred embodiments, is better understood when read in conjunction with the appended drawings. For the purpose of illustrating the invention, there is shown in the drawings an embodiment that is presently preferred, it being understood, however, that the invention is not limited to the specific apparatus and methods disclosed.

DETAILED DESCRIPTION OF THE PREFERRED EMBODIMENT

A lifting tool according to the present invention is a device that can be hung from a bridge or jib crane hoist hook, for example, and used to safely lift and rotate a large object, such as a rectangular enclosure. The lifting tool automatically adjusts to balance the object around its center of gravity to help a person to safely rotate the object up to 180 degrees. In a preferred embodiment, the invention can be used to lift such an enclosure from a transport cart, and to rotate the enclosure up to 180 degrees so that it can be placed upside down on a table, for example. Similarly, the invention can be used to lift the enclosure from the table, rotate it up to 180 degrees, and place it back, right side up, onto the cart.

The lifting tool requires no air or electric power assist to rotate the enclosure relatively quickly, easily, and safely up to 180 degrees in a restricted space. The tool also does not require the use of a counterweight to counterbalance the location of the center of gravity of the object to be lifted and rotated. Such counterweights typically add undesirable additional weight to the system. Similarly, although a simple rotating device, such as a spreader bar, with a gear box attached to its turning axis could be used to lift and invert a large object, such an implementation consumes additional space, and adds undesirable weight, cost, and cycle time to the inversion process. Likewise, when using a lifting tool that grabs and lifts the enclosure by its sides, it is difficult, if not impossible, to ensure that the lifting tool will grab the enclosure so as to balance it about its center of gravity.

On the other hand, a lifting tool according to the present invention is a relatively small, lightweight tool that uses the weight of the object and a unique configuration of interconnected members to accomplish its intended purpose with a relatively small cost. Moreover, the inventive tool provides an additional advantage in that it can be operated safely by one person.

Figure 1:
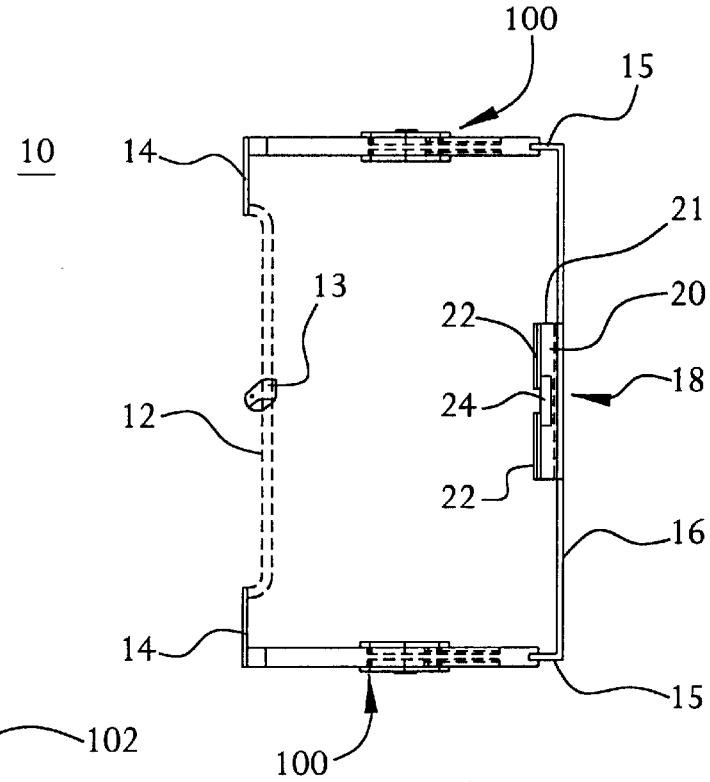
FIG. 1 is a top view of a lifting tool according to the present invention.
Figure 2:
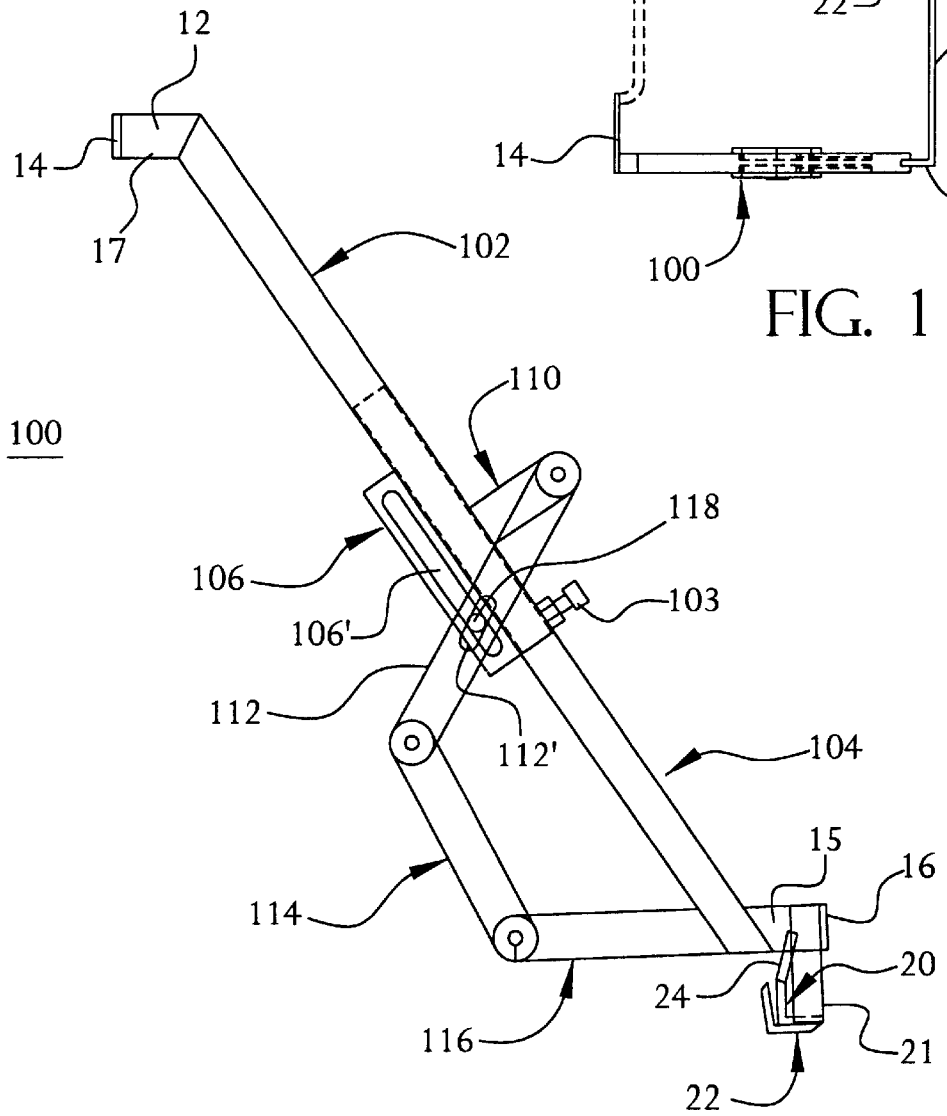
FIG. 2 is a side view of a lifting tool according to the present invention.

A lifting tool 10 according to the present invention will now be described in detail with reference to FIGS. 1 and 2. As shown in FIG. 1, lifting tool 10 includes a first rail 12 which is adapted to be coupled to a first end of the object that is to be lifted and rotated (e.g., to the open end of a transformer tank). Preferably, where the object to be lifted is a large, rectangular enclosure, such as a transformer tank, which has a flange around its open end, first rail 12 is preferably a rod, bar, or other such structure that is shaped to conform to the flange. Thus, rail 12 can be placed under the flange to support the open end of the tank.

Preferably, tool 10 includes a tab or strap 13, which is fitted onto rail 12 such that when rail 12 is set in place under the flange, a hole or holes in tab 13 are aligned with a pipe fitting on the side of the tank. Rail 12 can then be secured to the pipe fitting by means of a screw or the like to ensure that rail 12 will not slip out from the flange (and thereby causing tool 10 to slip off of the tank). Tab 13 can be made from a small piece of sheet metal that is wrapped around rail 12, extending a few inches away from it, or it can include a small hollow tube to which a small tab has been welded. In any event, it is desirable that tab 13 be slidably coupled to rail 12 so that the hole in tab 13 can be aligned with the pipe fitting after rail 12 has been set in place under the flange.

Lifting tool 10 also includes a second rail 16 that is adapted to be coupled to a second end of the object. Again, where the object to be lifted is a rectangular transformer tank, tool 10 can include an enclosure grasping assembly 18 that can be guided onto the second end of the object (the closed end of a rectangular tank, for example). Thus, after rail 12 is coupled to the first end of the object, rail 16 can be coupled to the second end of the object.

Typically, the closed end of a rectangular tank is recessed about 1–3 inches from the ends of the walls of the tank. To adapt assembly 18 to hold the second, or closed, end of the tank, assembly 18 preferably includes a first structural angle 24, which is fixedly coupled to rail 16 along a first length thereof. Preferably, structural angle 24 is welded to a bar 21, which itself is welded to rail 16. Assembly 18 also includes a second structural angle 22, which is fixedly coupled to rail 16 along a second length thereof However, as the closed end of a transformer tank usually includes a reinforcing brace that is welded to the closed end of the tank and to the rear wall (the wall which is typically grasped by assembly 18), it is preferred that lifting tool 10 include a pair of second structural angles 22, with a gap between them (as shown in FIG. 1) to accommodate the reinforcing brace. Preferably, structural angles 22 are offset from structural angle 20 by about ¼–⅜ of an inch, and are welded thereto. Thus, angles 20 and 22 form a "groove" into which the end of the tank wall can be set.

To assist the user in getting the end of the tank wall into the groove, assembly 18 can also include a guide 24 disposed between angles 22 as shown. Guide 24 is angled such that the ends of the walls of the tank can be set onto guide 24 and slid into the groove.

Lifting tool 10 also preferably includes two sets of inversion linkage 100. Each set of inversion linkage 100 is coupled to first rail 12 and to second rail 16 via plates 14 and 15 respectively. As shown in FIG. 2, each set of inversion linkage 100 includes a first or outer telescoping member 102, and a second or inner telescoping member 104. Preferably, telescoping members 102, 104 are lengths of hollow tubing having rectangular, or more preferably, square cross sections along their respective lengths. Telescoping members 102 and 104 are slidably coupled to one another such that telescoping member 104 can move axially relative to telescoping member 102. Preferably, telescoping member 104 is disposed coaxially within telescoping member 102.

To control the movement of telescoping members 102 and 104 relative to one another, linkage 100 includes a locking mechanism 103, such as a set screw, for example. When loosened (or "unlocked"), locking mechanism 103 allows inner telescoping member 104 to move freely with respect to outer telescoping member 102. When tightened (or "locked"), locking mechanism 103 prevents inner telescoping member 104 from moving relative to outer telescoping member 102. Preferably, once locking mechanism 103 has been set to size tool 10 to fit a specific size tank, tool 10 can be placed onto and lifted off of any number of such tanks without the need to resize the tool. This can be made possible due to the amount of play between the flange and pipe fitting on the tank. That is, when the tank is set down (on its closed end), rail 12 will slide down from the flange just enough so that tool 10 can be slipped off of the bottom of the tank.

A slider rail 106 is fixedly connected to the exterior of outer telescoping member 102. Preferably, slider rail 106 runs along a length of outer telescoping member 102 from the end of telescoping member 102 that is proximate inner telescoping member 104. Slider rail 106 includes a slot 106', which is elongated along a length of slider rail 106 as shown.

Linkage 100 also includes a plurality of rotational members 110, 112, 114, and 116 that work in combination to automatically balance the object to be lifted about its center of gravity. This facilitates safe and easy lifting and 180 degree rotation of the object (as will be described in detail below). As shown, a first end of rotational member 110 is fixedly connected (e.g., by welding) to outer telescoping member 102. The opposite end of rotational member 110 is rotationally connected to a first end of rotational member 112.

Rotational member 112 includes a slot 112' disposed along a length thereof. Slot 112' is located at approximately the middle portion of rotational member 112, so as to intersect with slot 106' of slider rail 106. A pivot pin 118, which can be a shoulder bolt, for example, extends through slots 106' and 112' to control the motion of rotational member 112 relative to outer telescoping member 102.

The opposite end of rotational member 112 is rotationally connected to a first end of rotational member 114. Similarly, the opposite end of rotational member 114 is rotationally connected to a first end of rotational member 116. The opposite end of rotational member 116 is fixedly connected to inner telescoping member 104.

Plate 15 is fixedly connected to telescoping member 104, and thereby couples linkage 100 to second rail 16. Preferably, a distal portion 17 of outer telescoping member 102 is bent such that distal portion 17 forms an angle of about 123 degrees with the remaining portion of member 102. Distal portion 17 is fixedly connected to plate 14, thereby coupling inversion linkage 100 to first rail 12. Alternatively, distal portion 17 can be a metal plate that is welded to telescoping member 102 and to plate 14.

The components that form a lifting tool of the present invention can be tailored (i.e., sized and shaped) to accommodate any desired range of tank sizes. The dimensions for the components should be chosen so that, for a predefined range of tank sizes, the location of pivot pin 1 18 (which is the pivot point of the linkage 100) automatically moves to coincide with the center of gravity of the object when the tool is coupled to the ends of the object. Specifically, for rectangular tanks or other objects having centers of gravity that move along a diagonal for similar objects of different sizes, the dimensions and configuration of the components are chosen so that, in a preferred embodiment, pivot pin 118 moves one half of the adjustment of inner telescoping member 104 relative to outer telescoping member 102. For example, if telescoping member 104 is moved six inches into telescoping member 102, pivot pin 118 moves three inches along slot 106'. In this way, whenever the fixture is affixed to a tank having a tank size within the predefined range, pivot pin 1 18 will be moved automatically to coincide with the center of gravity of the tank. By pivoting the tank at its center of gravity, lifting tool 10 allows a user to invert the tank easily and safely.

Figure 3A:
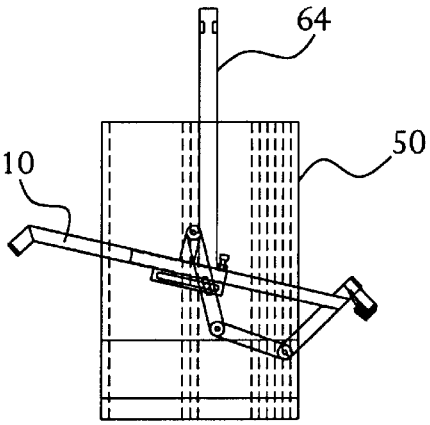
FIGS. 3A–3F are side views of a lifting tool according to the present invention shown at various points during the inversion of a rectangular enclosure.

FIGS. 3A–3F are side views of a lifting tool 10 according to the present invention shown at various points during the inversion of a rectangular enclosure 50. FIG. 3A depicts a lifting tool 10 positioned over enclosure 50. With rails 12 and 16 and inversion linkages 100 being longer than enclosure 50 is wide, lifting tool 10 can easily be lowered over enclosure 50 by a crane hoist (not shown). Preferably, lifting tool 10 is coupled to the crane or jib hoist via a spreader bar 60, which is depicted in detail in FIGS. 4A and 4B.

As shown, spreader bar 60 includes a pair of horizontal members 62 and a pair of vertical members 64. Preferably, at least one of the horizontal members 62 has a hole 66 for receiving a crane hook. Preferably, each of the horizontal members 62 is made of CRS, and is about 42 inches long, about 3 inches wide, and about 0.25 inches thick. Each vertical member is preferably about 2 inches wide and ½ inch thick. Each vertical member 64 is coupled to one of the sets of inversion linkage 100, preferably via pivot pin 18. The lengths of the vertical members can be adapted as suitable for the application.

Figure 3B:
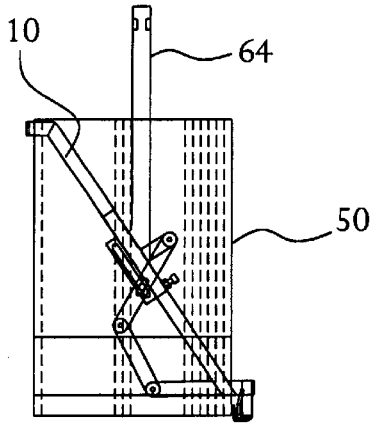
Figure 4A:
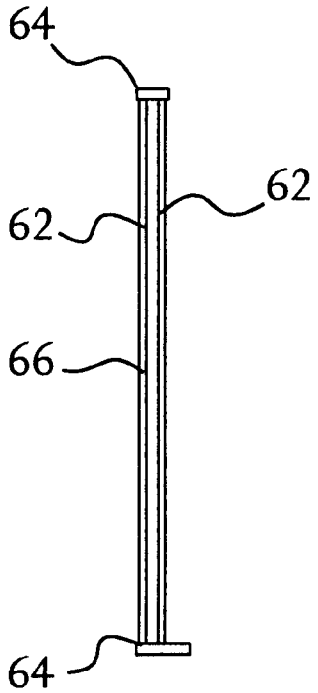
FIGS. 4A and 4B depict a spreader bar for coupling a lifting tool of the present invention to a crane hoist.
Figure 4B:
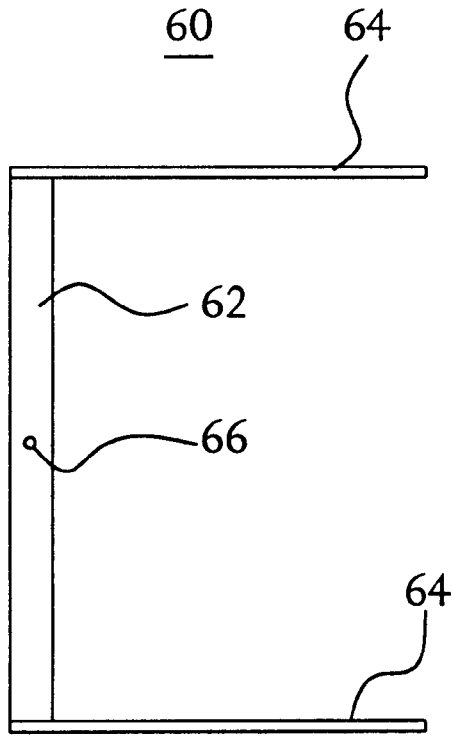

Once lowered onto enclosure 50 as shown in FIG. 3A, rail 12 can be secured to the top, or open end, of enclosure 50, as shown in FIG. 3B. Preferably, rail 12 is tailored to fit under a flange, as described above, and is secured by being screwed, for example, into a pipe fitting or the like on the tank wall. Thus, rail 12 is held in place under the flange or other rail receiving member of enclosure 50. Similarly, rail 12 can be clamped to the top of enclosure 50, or secured to enclosure 50 by any other suitable means.

Once rail 12 is secured to enclosure 50, inner telescoping member 104 can be adjusted relative to outer telescoping member 102 to cause the ends of the bottom, or closed end, of enclosure 50 to slide into the groove formed between angled bars 20 and 22. Locking mechanism 103 can then be locked, if necessary, to ensure that inner telescoping member 104 will not move relative to outer telescoping member 102, and thereby assuring that lifting tool 10 will not slip off of enclosure 50 during rotation.

Figure 3C:
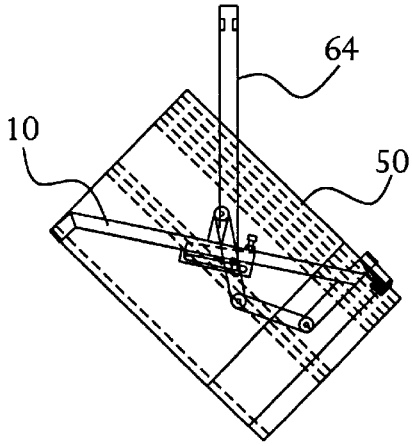
Figure 3D:
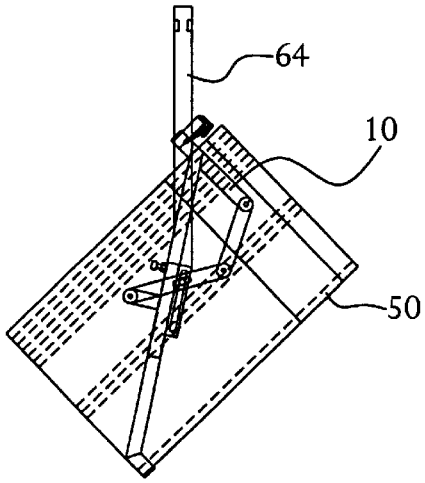
Figure 3E:
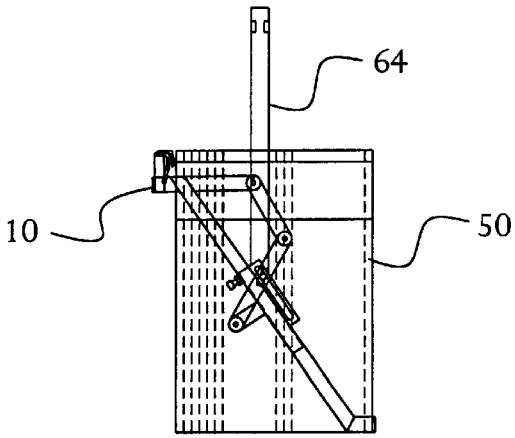

As inner telescoping member 104 is adjusted with respect to outer telescoping member 102, rotational members 106, 108, 110, and 112 cooperate to cause pivot pin 118 to coincide with the center of gravity of enclosure 50. As a result, a user can rotate enclosure 50 easily and safely as shown in FIGS. 3C–D, until enclosure 50 is completely inverted (i.e., rotated through 180 degrees), as shown in FIG. 3E.

Figure 3F:
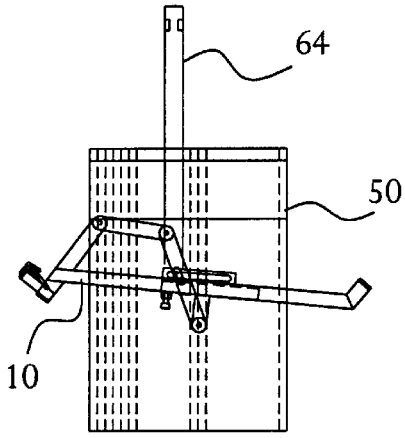

Once the tank is inverted, lifting tool 10 can be removed from and lifted off of enclosure 50, as shown in FIG. 3F. Enclosure 50 can be reinverted by reversing the process just described.

In a preferred embodiment of the present invention, a lifting tool 100 has been designed to safely lift and rotate rectangular enclosures ranging from 30–36 inches in width, from 15 to 20 inches in depth, and from 24 to 32 inches in height. To accommodate this range of enclosure sizes, it has been determined that the components described above should have the following, optimum, dimensions. It should be understood that the dimensions provided herein represent a presently preferred embodiment and can be adjusted appropriately to provide optimal results for any desired range of tank sizes.

In a preferred embodiment, rail 12 is a metal rod having a length of about 28.5 inches, with curves of about 0.625 radians at each end. Rail 12 is tailored to fit under the flange or other rail receiving member of the tank that is to be lifted and inverted. Thus, although it is preferred that rail 12 is a solid metal rod having a circular cross-section, rail 12 could also be hollow (to reduce the weight of tool 10) or rectangular in cross-section.

Preferably, tab 13 is a metal strap formed from 16 gauge sheet metal, having a width of about 1–1.5 inches, and which extends away from rail 12 by about 3 inches. Tab 13 could also be apiece of metal tube that surrounds rail 12, with a 3 inch tab welded to it. In either case, the tab or strap 13 includes a hole so that it can be bolted to a pipe fitting on the wall of the enclosure.

Each plate 14 is a metal plate having a thickness of about 0.25 inches, a length of about 6 inches, and a width of about 1.5 inches. Thus, lifting tool 10 has an overall length (between distal ends of plates 14) of about 40.5 inches. Plates 15 are metal plates, each having a thickness of about 0.25 inches, a long side length of about 2.61 inches, and a width of about 1.5 inches.

Rail 16 is a metal bar having a length of about 39.25 inches. Structural angle 20 is a 1½×1³⁄₁₆ inch metal structural angle having a length of about 12 inches. Each of structural angles 22 is a 1½×1³⁄₁₆ inch metal structural angle having a length of about 5 inches. The outer walls of the structural angles 20, 22 form angles of approximately 90 degrees with one another. The inner wall of angle 22 is tapered, as shown, to form a groove between the angles. Guide 24 is a metal plate having a thickness of about 0.25 inches, a width of about 2 inches, and a length of about 4 inches.

Outer telescoping member 102 is made from 14 gauge sheet metal (having a thickness of about 0.083 inches), and has a length of about 21.5 inches and a cross-section of about 1.5 inches by 1.5 inches (exterior perimeter). Inner telescoping member 104 is preferably made from 11 gauge sheet metal (having a thickness of about 0.120 inches), and has a length of about 23.64 inches and a cross-section of about 1.25 inches by 1.25 inches. Slider rail 106 has a length of about 7.5 inches. Slot 106' has a length of about 6.75 inches and a width of about 0.51 inches.

Rotational member 110 is a metal plate having a width of about 1.50 inches, and a length of about 3.09 inches from the end thereof that is fixedly connected to outer telescoping member 102 to the point at which it is rotationally connected to rotational member 112. Rotational member 112 is a metal plate having a length of about 10.50 inches from the point at which it is rotationally connected to rotational member 110 to the point at which it is rotationally connected to rotational member 114. Slot 112' has a length of about 1.64 inches and a width of about 0.51 inches. The ends of slot 112' are located about 4.87 inches from the points at which rotational member 112 is connected to rotational members 110 and 114.

Rotational member 114 is a metal plate having a width of about 1.50 inches, and a length of about 7.63 inches from the point at which it is rotationally connected to rotational member 112 to the point at which it is rotationally connected to rotational member 116. Rotational member 116 is a metal plate having a width of about 1.5 inches, and a long side length of about 7.37 inches from the point at which it is rotationally connected to rotational member 114 to the point at which it is fixedly connected to inner telescoping member 104. Note that the end of rotational member 116 that is connected to inner telescoping member 104 is angled. Preferably, this end of rotational member 116 forms an angle of about 57 degrees with the long side thereof The rotational members have ⅜ inch diameter holes at the points where they are rotationally connected to one another. Preferably, ⅜ inch shoulder bolts are used to establish the rotational connections. Similarly, the slots are about 0.51 inches to accommodate ½ inch diameter shoulder bolts.

Thus there has been described a preferred embodiment of a lifting tool for automatic centering and 180 degree rotation of large rectangular enclosures. Those skilled in the art will appreciate that numerous changes and modifications may be made to the preferred embodiment of the invention, and that such changes and modifications may be made without departing from the spirit of the invention. For example, although a lifting tool having four rotational members has been described, it should be understood that this is but one possible configuration for a tool according to the invention. For example, the second rotational member can be coupled to the second telescoping member in any manner that will cause the pivot pin to automatically coincide with the center of gravity of the object when the tool is sized to fit the object. Also, the tool is not limited to objects, such as rectangular enclosures, which have centers of gravity that vary along a diagonal for similar objects of different sizes. It is therefore intended that the appended claims cover all such equivalent variations as fall within the true spirit and scope of the invention.

I claim:

1. A tool for lifting and rotating an object, comprising:

a first rail adapted to be coupled to a first end of the object;

a second rail adapted to be coupled to a second end of the object; and an inversion linkage coupled to the first rail and to the second rail, the inversion linkage comprising:

a first telescoping member having a slider rail fixedly connected to an exterior thereof, the slider rail having a slot elongated along a length thereof;

a second telescoping member slidably coupled to the first telescoping member such that the second telescoping member can move axially relative to the first telescoping member;

a first rotational member fixedly coupled to the first telescoping member; and a second rotational member coupled to the second telescoping member and rotationally coupled to the first rotational member, the second rotational member having a slot elongated along a length thereof, the second rotational member coupled to the slider rail by a pivot pin extending through the slider rail slot and the second rotational member slot.

2. The lifting tool of claim 1, further comprising:

a third rotational member rotationally coupled to the second rotational member; and a fourth rotational member rotationally coupled to the third rotational member and fixedly coupled to the second telescoping member.

3. The lifting tool of claim 1, wherein the pivot pin moves axially relative to the first telescoping member in response to axial movement of the second telescoping member relative to the first telescoping member.

4. The lifting tool of claim 1, further comprising:

an enclosure grasping assembly coupled to the second rail and adapted to couple the second rail to the second end of the object.

5. The tool of claim 4, wherein the enclosure grasping assembly comprises:

a first structural angle fixedly coupled to the second rail; and a second structural angle fixedly coupled to the first structural angle so as to form a groove for receiving the second end of the object.

6. The tool of claim 1, further comprising:

a tab, slidably coupled to the first rail, and having a hole therein for securing the tab to the object.

7. A tool for lifting and inverting an object having a center of gravity, comprisng:

a first rail adapted to be coupled to a first end of the object;

a second rail adapted to be coupled to a second end of the object; and inversion linkage for inverting the object, wherein the inversion linkage is coupled to the first rail and to the second rail, the inversion linkage comprising a pivot pin that automatically moves into coincidence with the center of gravity of the object when the first rail is coupled to the first end of the object and the second rail is coupled to the second end of the object.

8. A tool for lifting and rotating an object having a center of gravity, comprising:

a first rail adapted to be coupled to a first end of the object;

a second rail adapted to be coupled to a second end of the object; and an inversion linkage coupled to the first rail and to the second rail, the inversion linkage comprising:

a pivot pin that automatically moves into coincidence with the center of gravity of the object when the first rail is coupled to the first end of the object and the second rail is coupled to the second end of the object;

a first telescoping member having a slider rail fixedly connected to an exterior thereof, the slider rail having a slot elongated along a length thereof;

a second telescoping member slidably coupled to the first telescoping member such that the second telescoping member can move axially relative to the first telescoping member;

a first rotational member fixedly coupled to the first telescoping member; and a second rotational member coupled to the second telescoping member and rotationally coupled to the first rotational member, the second rotational member having a slot elongated along a length thereof, the second rotational member coupled to the slider rail by a pivot pin extending through the slider rail slot and the second rotational member slot.

9. The lifting tool of claim 8, wherein the inversion linkage further comprises:

a third rotational member rotationally coupled to the second rotational member; and a fourth rotational member rotationally coupled to the third rotational member and fixedly coupled to the second telescoping member.

10. The lifting tool of claim 8, wherein the pivot pin moves axially relative to the first telescoping member in response to axial movement of the second telescoping member relative to the first telescoping member.

* * * * *

UNITED STATES PATENT AND TRADEMARK OFFICE

CERTIFICATE OF CORRECTION

PATENT NO. : 6,416,099 B1 
DATED : July 9, 2002
INVENTOR(S) : Frank Ward James, Jr.

It is certified that error appears in the above-identified patent and that said Letters Patent is hereby corrected as shown below:

Column 4,
Line 3, "Lifting Tool 10" should read -- Lifting Tool 100 --

Column 5,
Line 17, "rotational member 112" should read -- rotational member 114 --
Line 41, "pivot pin 1 18" should read -- pivot pin 118 --.
Line 55, "pivot pin 1 18" should read -- pivot pin 118 --.

Column 6,
Line 9, "pivot pin 18" should read -- pivot pin 118 --.

Signed and Sealed this

Tenth Day of December, 2002

JAMES E. ROGAN
*Director of the United States Patent and Trademark Office*